US006653920B1

(12) United States Patent
Chen

(10) Patent No.: US 6,653,920 B1
(45) Date of Patent: Nov. 25, 2003

(54) MAGNETIC DEVICE HAVING INCREASED MAGNETIC FIELD INTENSITY AND UNIDIRECTIONAL MAGNETIC LINE OF FORCE

(76) Inventor: Ming Po Chen, P.O. Box 63-298, Taichung (TW), 406

( * ) Notice: Subject to any disclaimer, the term of this patent is extended or adjusted under 35 U.S.C. 154(b) by 0 days.

(21) Appl. No.: 10/388,882

(22) Filed: Mar. 16, 2003

(51) Int. Cl.[7] ..... H01F 7/02

(52) U.S. Cl. ..... 335/296; 335/302; 335/304; 335/306

(58) Field of Search ..... 335/285, 296, 335/301–306; 210/222

(56) References Cited

U.S. PATENT DOCUMENTS 5,019,863 A * 5/1991 Quimby ..... 335/210

5,939,964 A * 8/1999 Domigan ..... 335/306

* cited by examiner

*Primary Examiner*—Ramon M. Barrera

(57) ABSTRACT

A magnetic device includes a core received in a housing and having three or more outer peripheral surfaces and having one end received in the housing and the other end facing out of the housing. Three or more magnetic members are attached onto the outer peripheral surfaces of the core and secured to the core and the housing with fasteners. The magnetic members include one pole arranged closer to the core and the other pole distal to the core, in order to increase the magnetic field intensity, and to form a unidirectional magnetic line of force, and for allowing the magnetic device to be strongly attracted onto various objects.

13 Claims, 11 Drawing Sheets

MAGNETIC DEVICE HAVING INCREASED MAGNETIC FIELD INTENSITY AND UNIDIRECTIONAL MAGNETIC LINE OF FORCE

BACKGROUND OF THE INVENTION

1. Field of the Invention

The present invention relates to a magnetic device, and more particularly to a magnetic device having a unidirectional magnetic field and having an increased magnetic field intensity.

2. Description of the Prior Art

Typical magnetic members or typical magnets are provided for attaching or for being attracted onto various magnetic objects or metal or magnetically attractable objects. However, the typical magnets or the typical magnetic members include a less magnetic field intensity that may not be solidly attached or attracted onto objects, and that may be easily disengaged or separated from the objects after use.

The other typical magnetic devices may comprise a number of magnetic members secured together in series, in order to increase the magnetic field intensity. However, the magnetic field intensity normally may not be increased to the required quantity, because the magnetic members secured together in series, and because the magnetic line of force of the magnetic members or magnets may not be unified or combined together in order to form a unidirectional line of force.

The present invention has arisen to mitigate and/or obviate the afore-described disadvantages of the conventional magnetic devices.

SUMMARY OF THE INVENTION

The primary objective of the present invention is to provide a magnetic device including a number of magnetic members to be secured together to increase the magnetic field intensity thereof.

The other objective of the present invention is to provide a magnetic device including a number of magnetic members to be secured together to form a unidirectional magnetic line of force.

The further objective of the present invention is to provide a magnetic device including a number of magnetic members to be solidly secured or attached onto various objects with increased magnetic field intensity.

In accordance with one aspect of the invention, there is provided a magnetic device comprising a housing including a chamber formed therein, a core received in the chamber of the housing, and including at least three outer peripheral surfaces, and including a first end received in the chamber of the housing, and including a second end facing out of the housing, at least three magnetic members attached onto the outer peripheral surfaces of the core respectively, and means for securing the core and the magnetic members in the chamber of the housing. The magnetic members include a first pole arranged closer to the core and include a second pole arranged distal to the core, in order to increase the magnetic field intensity of the magnetic device, and to form a unidirectional magnetic line of force for the magnetic device, and for allowing the magnetic device to be solidly or strongly attached or attracted or secured onto various objects.

The core includes a plate provided on the second end thereof, the plate includes an outer peripheral portion extended laterally and outwardly beyond the core. The plate of the core includes a curved outer surface formed thereon to engage onto corresponding curved outer surfaces of objects.

Tree or more blocks may further be provided and attached onto the magnetic members respectively, and received in the chamber of the housing. The blocks each include an inner portion having a recess formed therein to partially receive the magnetic members respectively, and to solidly anchor or secure the magnetic members and the blocks together. The blocks each include a curved outer surface formed thereon to engage onto corresponding curved outer surfaces of objects.

The housing includes a bottom panel, and at least three outer panels extended upwardly from the bottom panel of the housing to form the chamber of the housing, and to engage onto the blocks respectively. The core and two of the blocks each include an aperture formed therein, and two of the outer panels of the housing each include an orifice formed therein, the securing means includes a fastener engaged through the apertures of the core and the blocks and the orifice the outer panels of the housing, in order to secure the core and the blocks and the outer panels of the housing together.

The housing may further include three or more walls extended upwardly from the bottom panel of the housing, in order to form the chamber of the housing together with the outer panels.

Further objectives and advantages of the present invention will become apparent from a careful reading of the detailed description provided herein below, with appropriate reference to the accompanying drawings.

DETAILED DESCRIPTION OF THE PREFERRED EMBODIMENT

Figure 1:
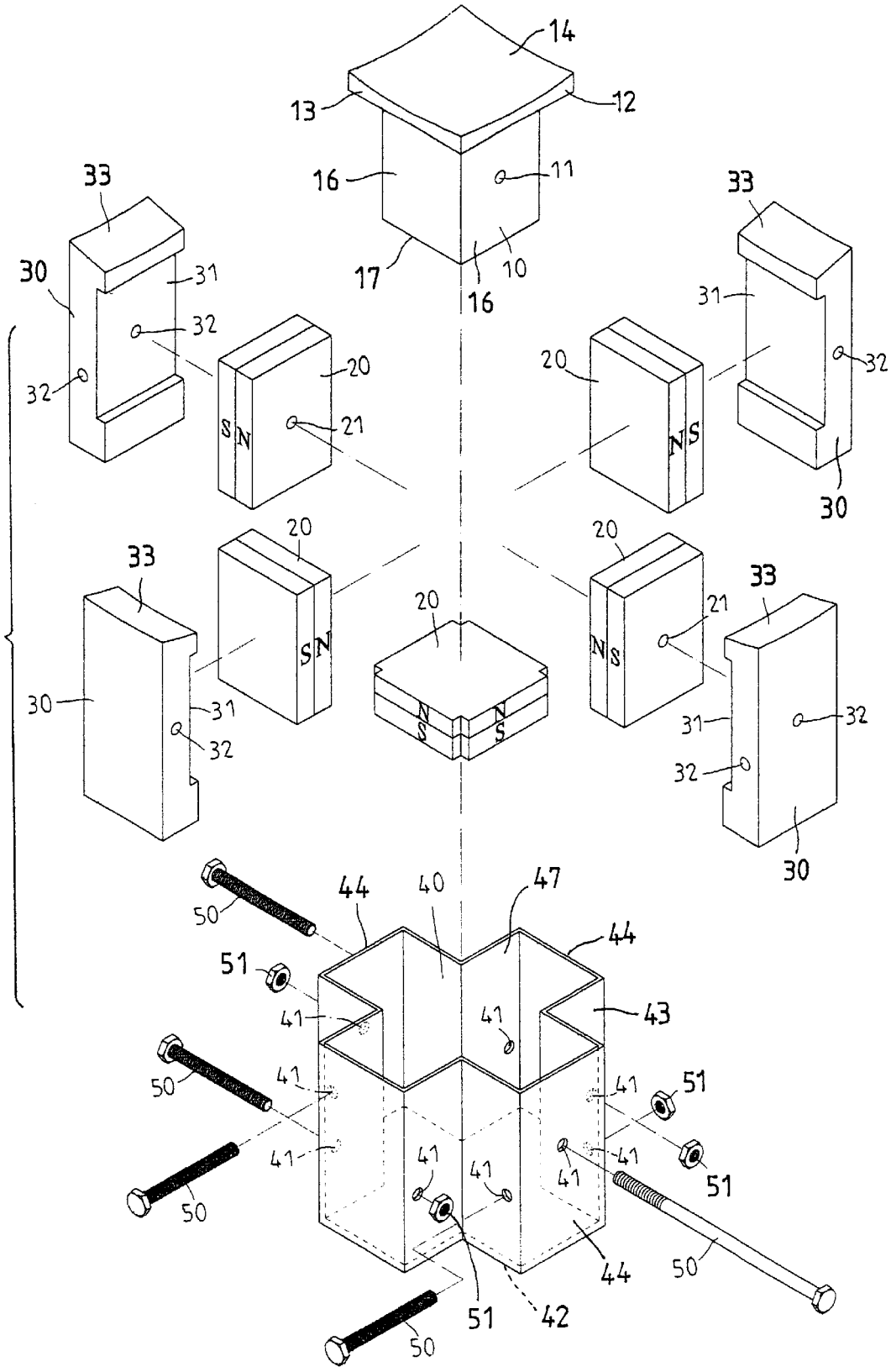
FIG. 1 is an exploded view of a magnetic device in accordance with the present invention.
Figure 2:
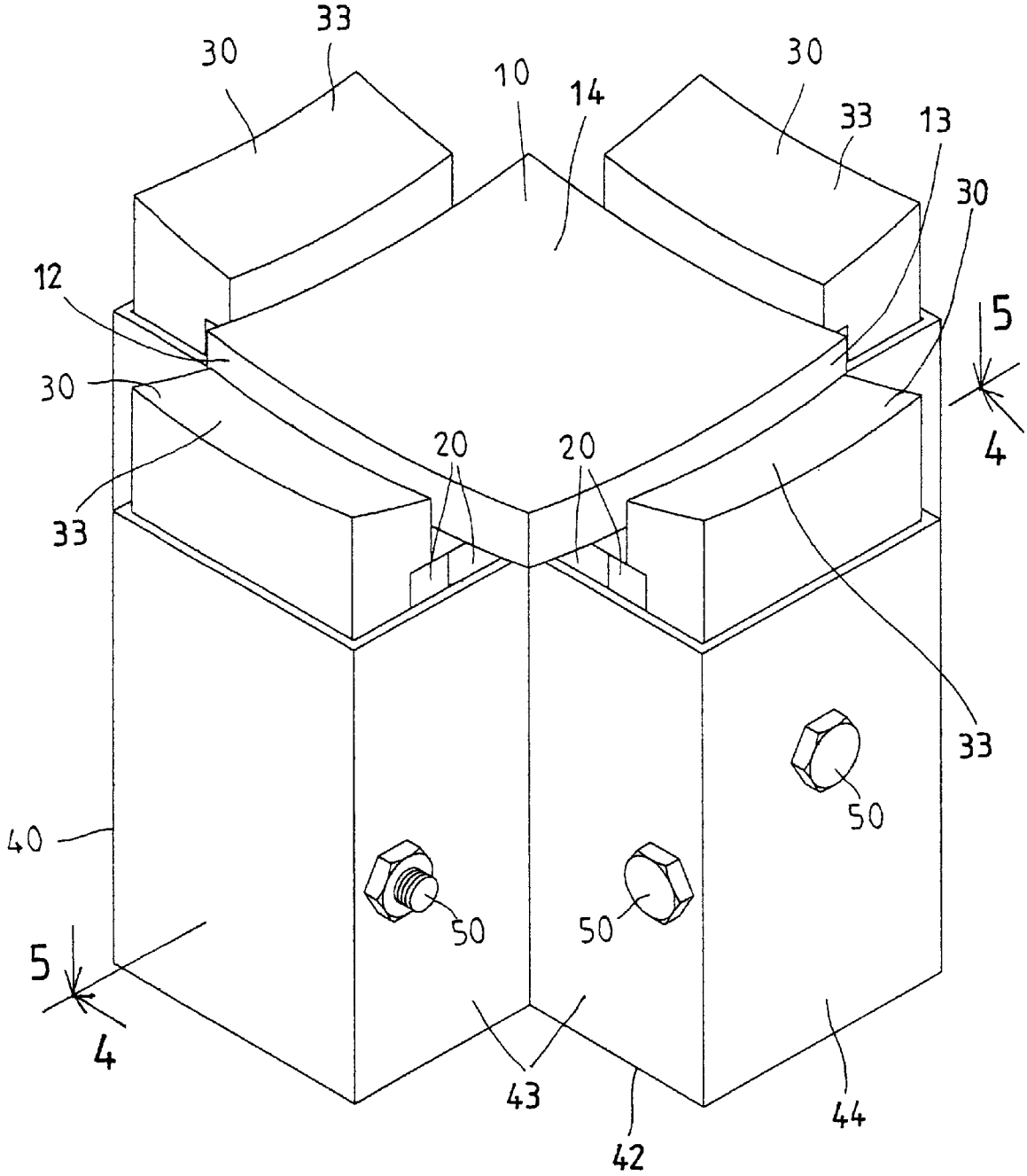
FIG. 2 is a perspective view of the magnetic device.
Figure 3:
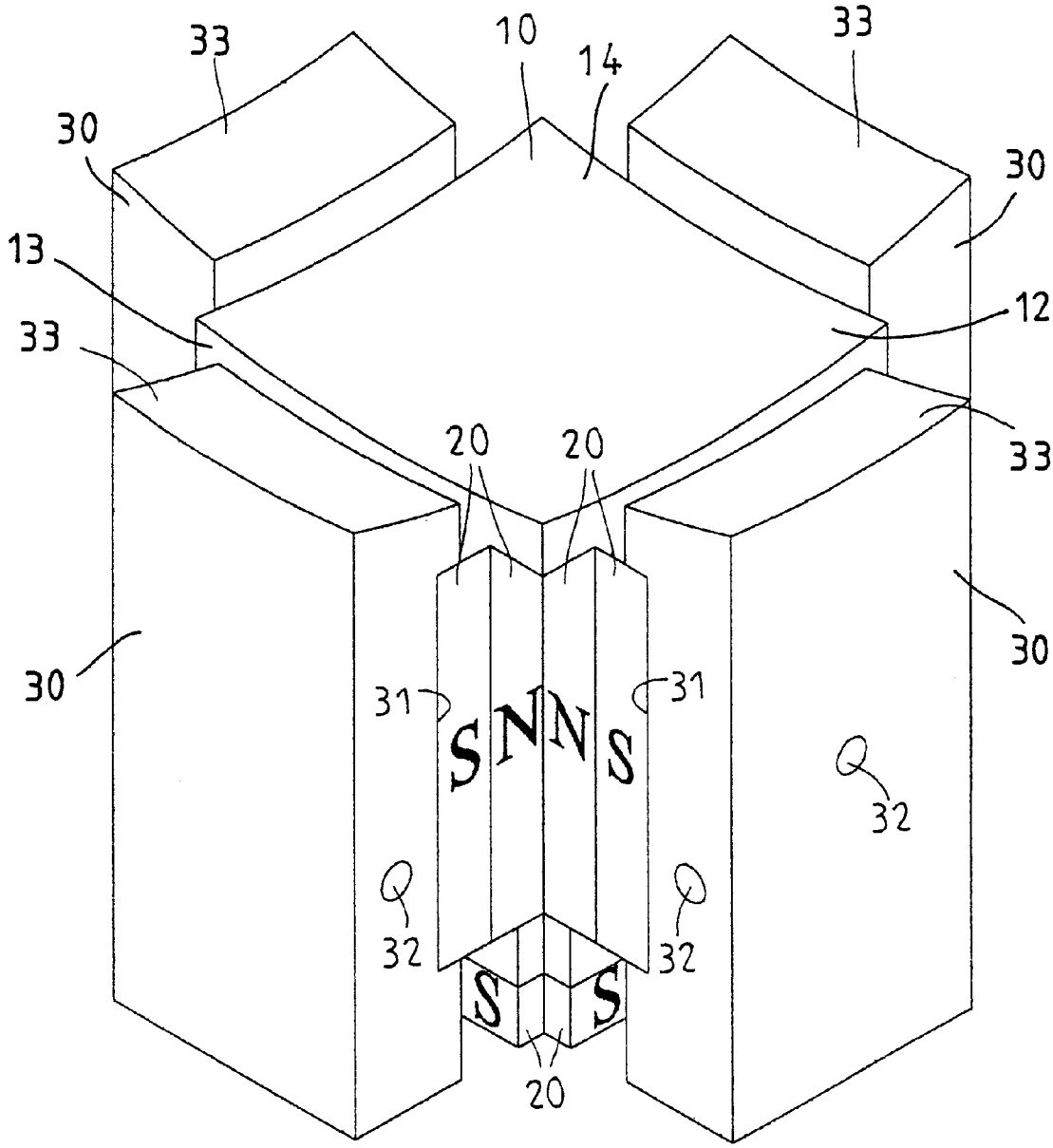
FIG. 3 is a perspective view of the magnetic device, in which an outer housing of the magnetic device has been removed.
Figure 4:
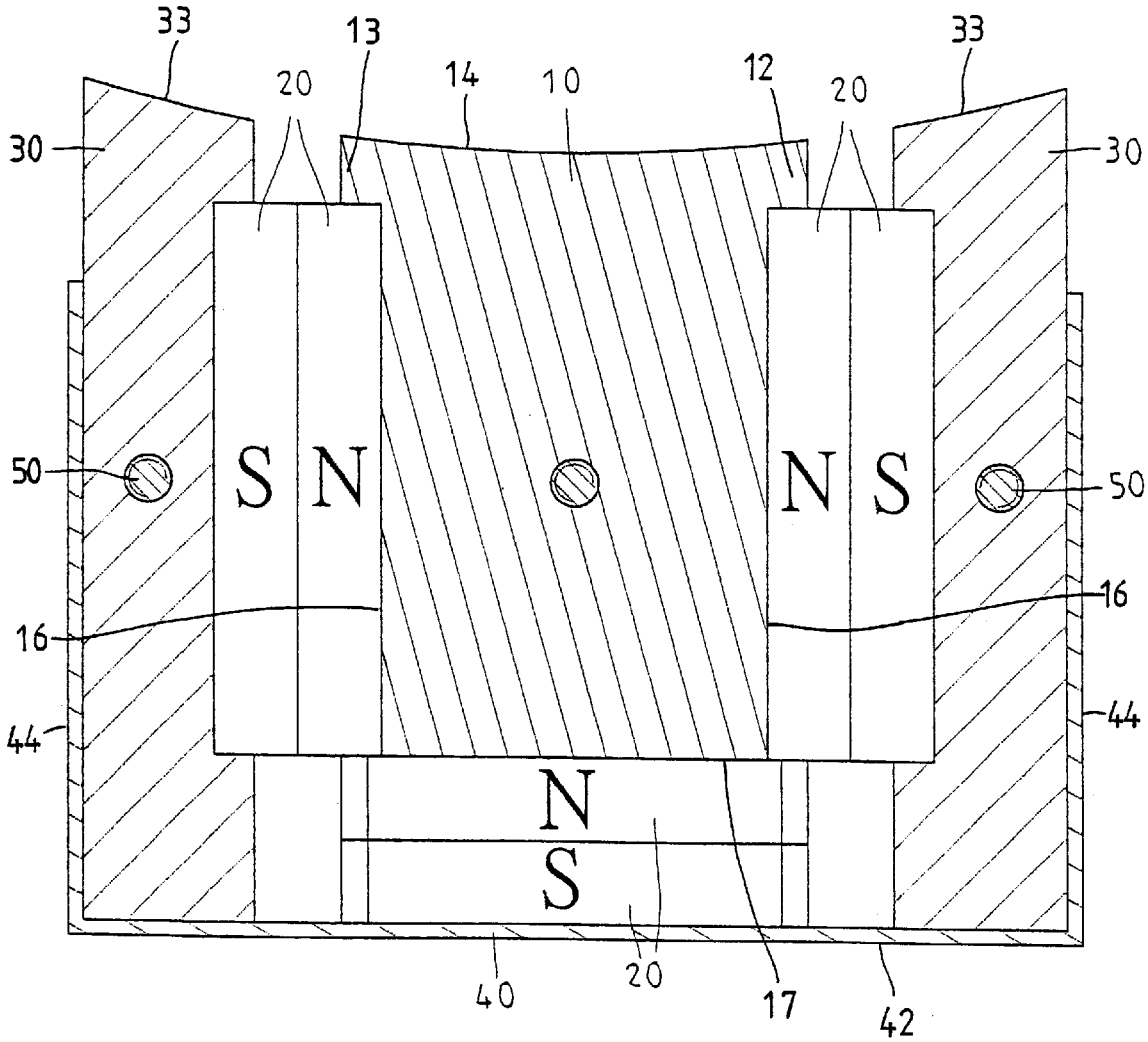
FIGS. 4, 5 are cross sectional views taken along lines 4—4 and 5—5 of FIG. 2 respectively.
Figure 5:
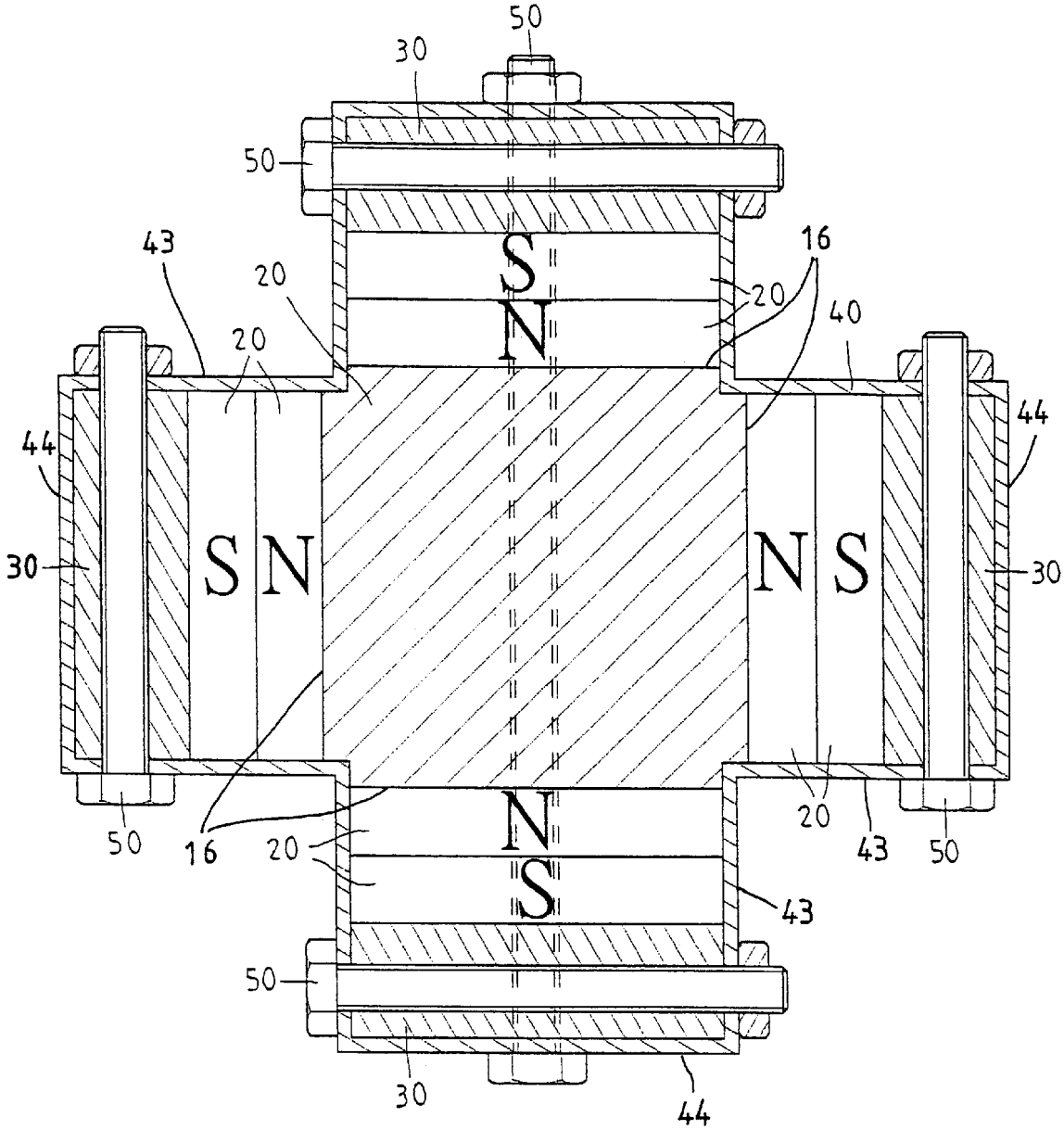
Figure 6:
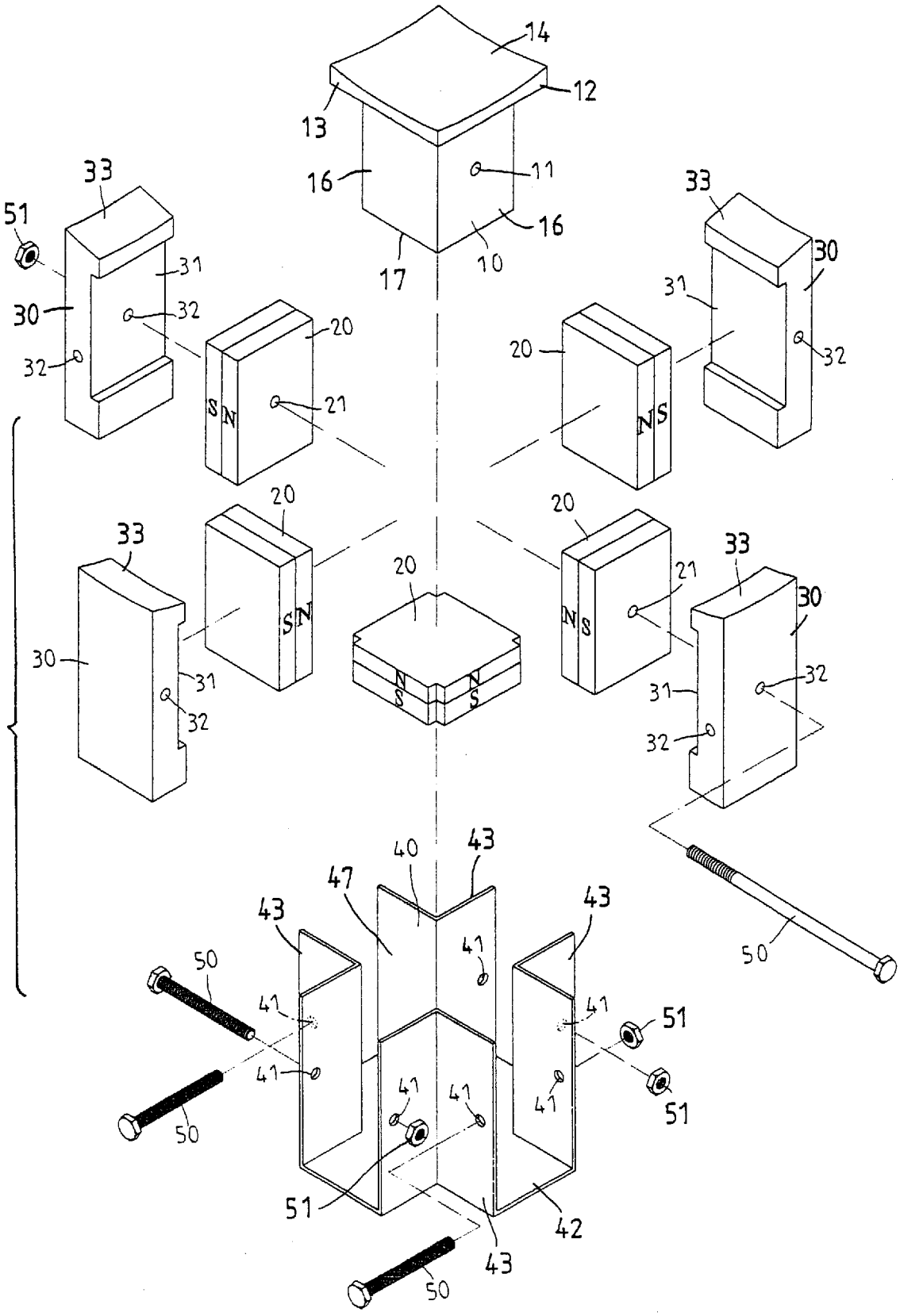
FIG. 6 is an exploded view similar to FIG. 1, illustrating another embodiment of the magnetic device.
Figure 7:
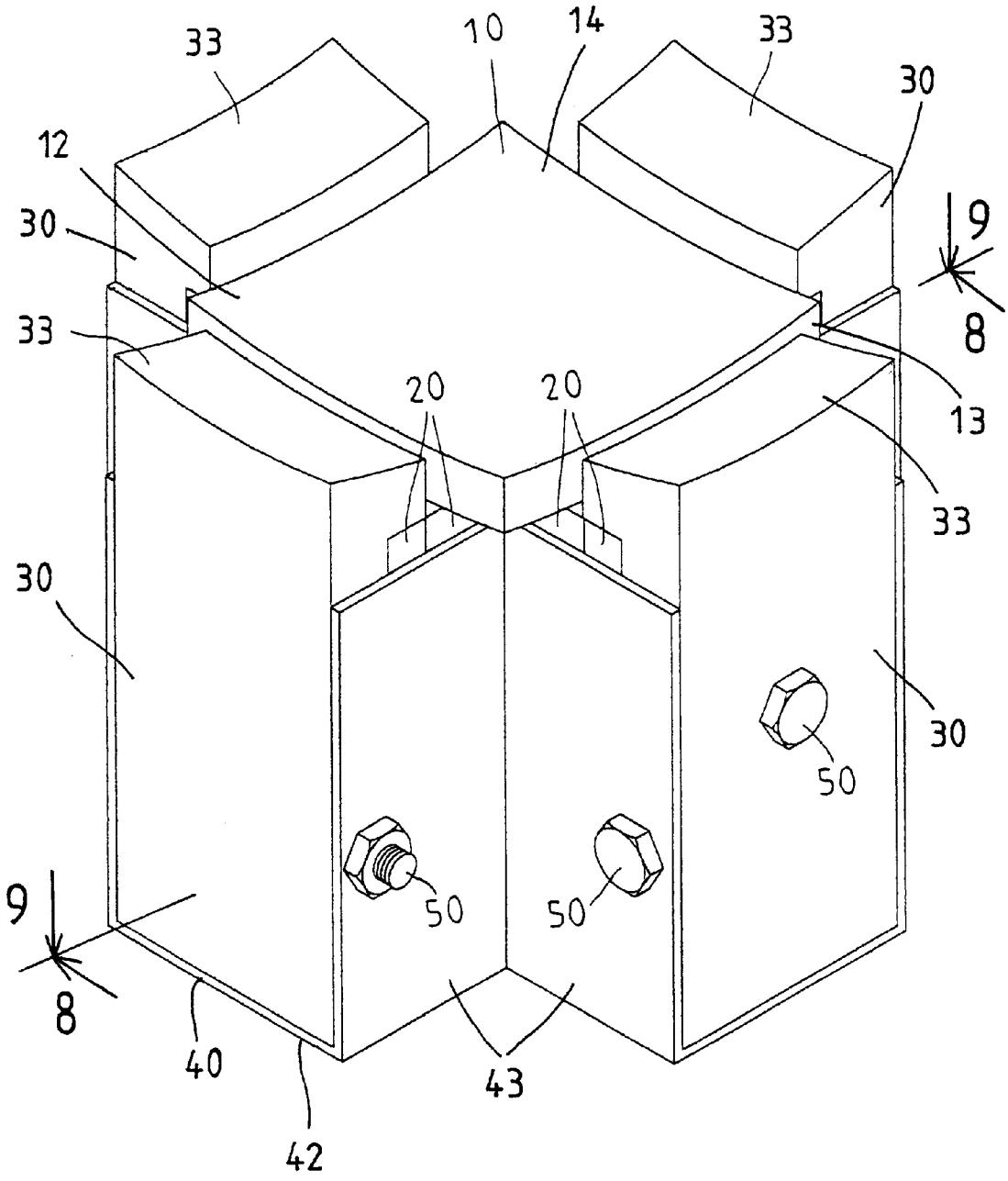
FIG. 7 is a perspective view of the magnetic device as shown in FIG. 6.
Figure 8:
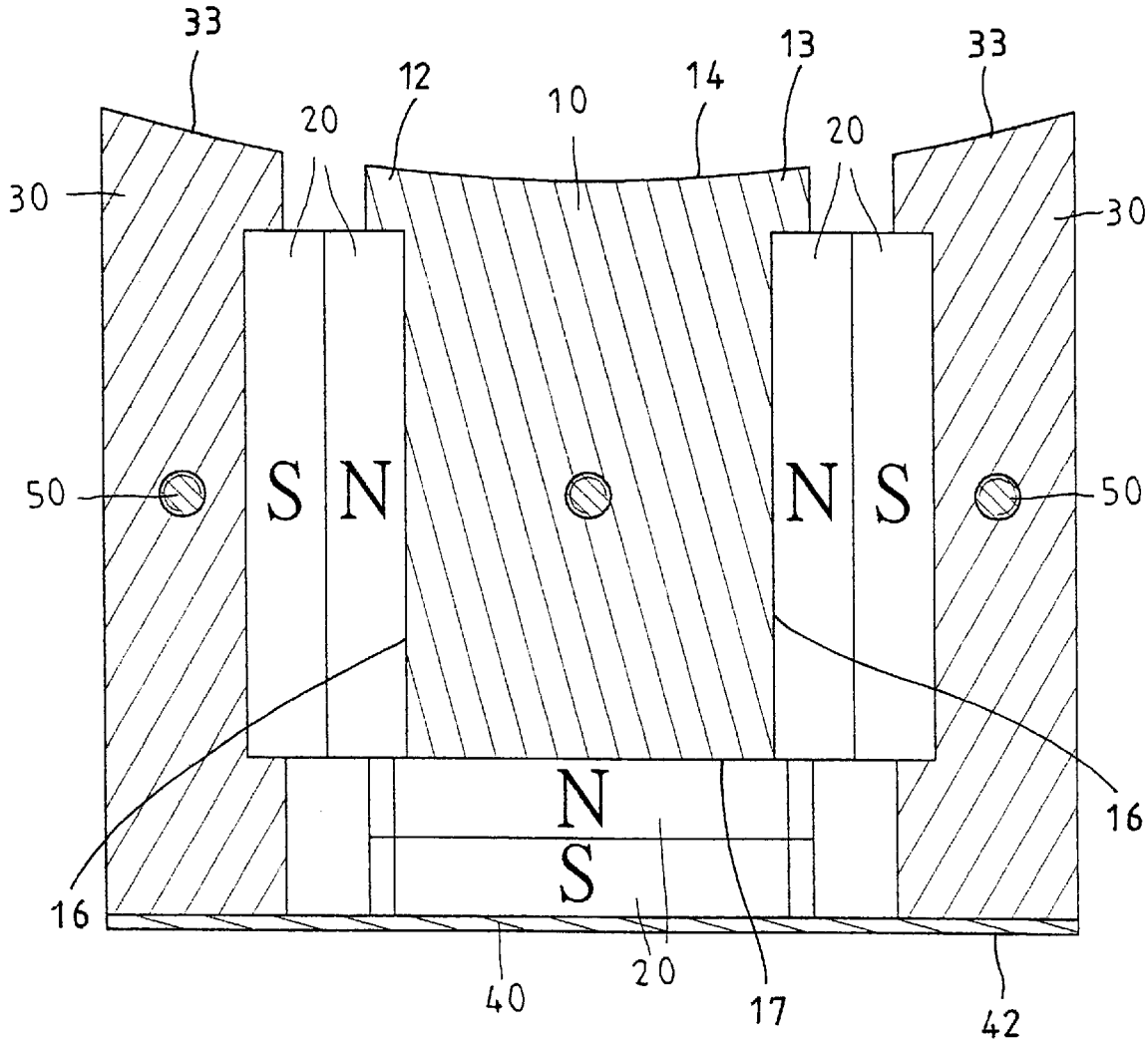
FIGS. 8, 9 are cross sectional views taken along lines 8—8 and 9—9 of FIG. 7 respectively.
Figure 9:
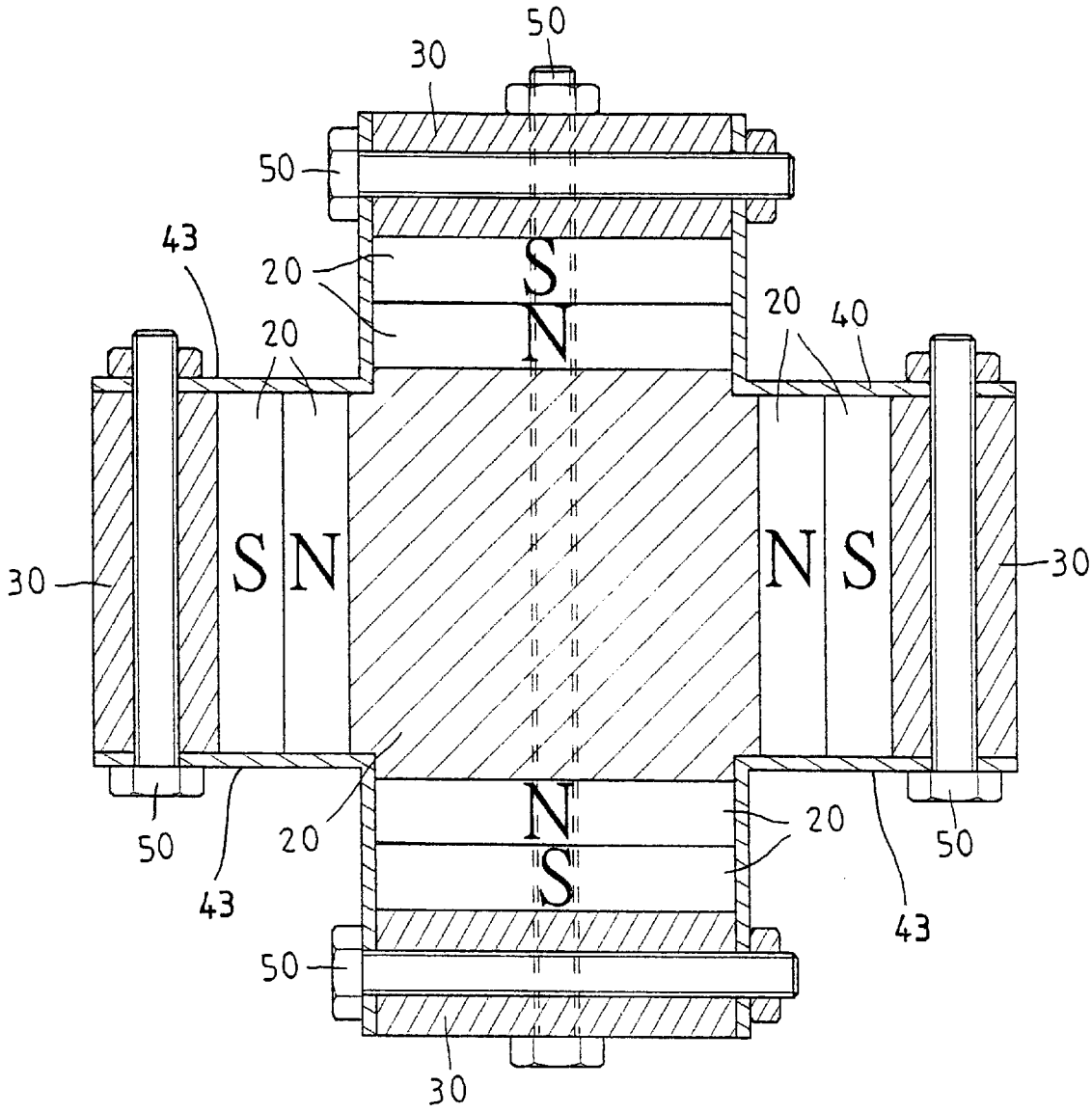

Referring to the drawings, and initially to FIGS. 1–5, a magnetic device in accordance with the present invention comprises a core 10, a number of magnetic members 20 attached to the outer peripheral portion of the core 10, and a number of blocks 30 attached onto the magnetic members 20. The core 10 and the magnetic members 20 and the blocks 30 are received in and secured to an outer housing 40.

The housing 40 includes a number of orifices 41 formed therein for receiving fasteners 50, and the core 10 and some of the magnetic members 20 and the blocks 30 may include one or more apertures 11, 21, 32 formed therein to receive the fasteners 50, and thus for allowing the core 10 and the magnetic members 20 and the blocks 30 to be solidly secured in the housing 40 with the fasteners 50.

The housing 40 includes a bottom panel 42, and a number of partitions or walls 43 and outer panels 44 extended upwardly from the bottom panel 42, in order to form or define a chamber 47 in the housing 40, and to receive the core 10 and the magnetic members 20 and the blocks 30 within the chamber 47 of the housing 40.

The core 10 may include a plate 12 disposed on one end, such as the upper end thereof that faces out of the housing 40. The plate 12 includes an outer peripheral portion 13 extended laterally and outwardly beyond the core 10, and may include a triangular, rectangular, or other polygonal cross section, having three or more outer surfaces 16 formed thereon, and may include a bottom surface 17 formed or provided thereon.

For example, as shown in the drawing figures, the core 10 includes a rectangular or square cross section having four outer surfaces 16 formed thereon and having a bottom surface 17 formed or provided thereon. Five magnetic members 20 are provided and attached onto the four outer surfaces 16 and the bottom surface 17 of the core 10.

Four blocks 30 are attached onto the four magnetic members 20 that are attached onto the four outer surfaces 16 of the core 10 respectively, and each may include a recess 31 formed in the inner portion thereof, to partially receive the respective magnetic members 20, and thus to anchor and to retain the magnetic members 20 in the blocks 30 respectively. The blocks 30 are preferably made of metal or iron materials.

The fasteners 50 may be engaged through the orifices 41 of two of the opposite outer panels 44 and the apertures 32, 21, 11 of two opposite blocks 30 and two opposite magnetic members 20 and the core 10, in order to secure the core 10 and the magnetic members 20 and the blocks 30 together.

The other fasteners 50 may be engaged through the orifices 41 of the walls 43 and the apertures 32 of the blocks 30, in order to secure the blocks 30 to the walls 43 of the housing 40. A number of lock nuts 51 may further be provided and threaded to the fasteners 50 respectively, in order to further solidly secure the core 10 and the magnetic members 20 and the blocks 30 to the housing 40.

The magnetic member 20 which is engaged with the bottom surface 17 of the core 10 may then be solidly retained between the core 10 and the bottom panel 42 of the housing 40, when the core 10 and the magnetic members 20 and the blocks 30 are secured to the housing 40 with the fasteners 50.

Alternatively, as shown in FIGS. 6–9, without the outer panels 44 of the housing 40, the core 10 may also be secured to two opposite blocks 30 and two opposite magnetic members 20, and the blocks 30 may then be secured to the walls 43 of the housing 40 with the fasteners 50, such that the core 10 may also be secured to the housing 40 that have no outer panels 44.

As shown in FIGS. 1–4, 6–8, 10, and 11, the plate 12 of the core 10 may include a curved outer surface 14 formed thereon, and the blocks 30 may also each include a curved outer surface 33 formed thereon. The curved outer surfaces 14, 33 of the plate 12 and the blocks 30 include a curvature corresponding to that of the outer peripheral surface 71 of an object 70 (FIGS. 10, 11), for allowing the core 10 and the blocks 30 to be snugly attached onto the outer peripheral surface 71 of an object 70.

In addition, the north poles N of the magnetic members 20 are arranged closer to the core 10, and the south poles S of the magnetic members 20 are arranged distal to the core 10, for allowing the poles of the magnetic members 20 to be combined together to form a unidirectional magnetic line of force and to increase the magnetic field intensity of the magnetic device in accordance with the present invention.

Figure 10:
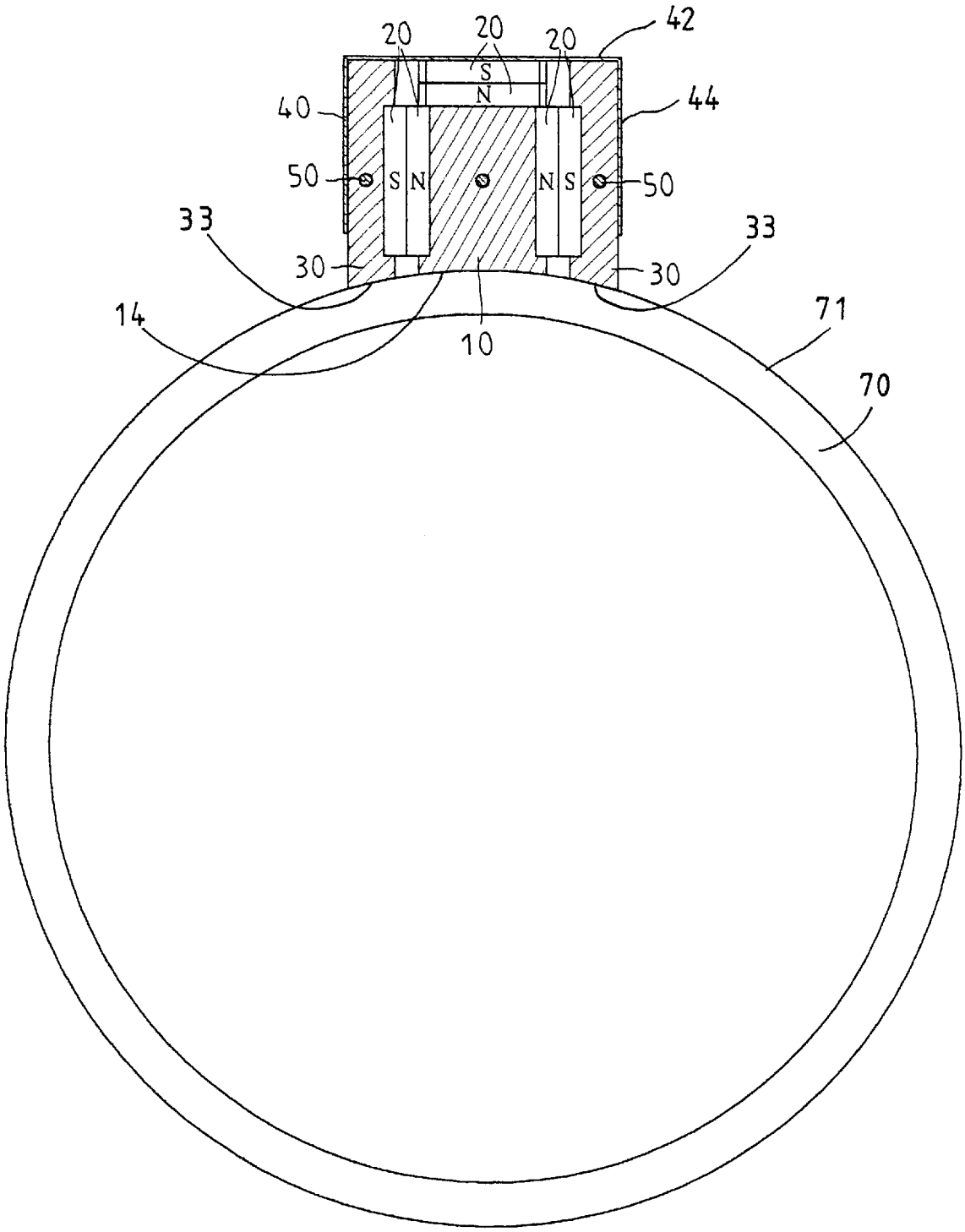
FIG. 10 is a cross sectional view similar to FIG. 4, illustrating the operation of the magnetic device as shown in FIGS. 1–5.
Figure 11:
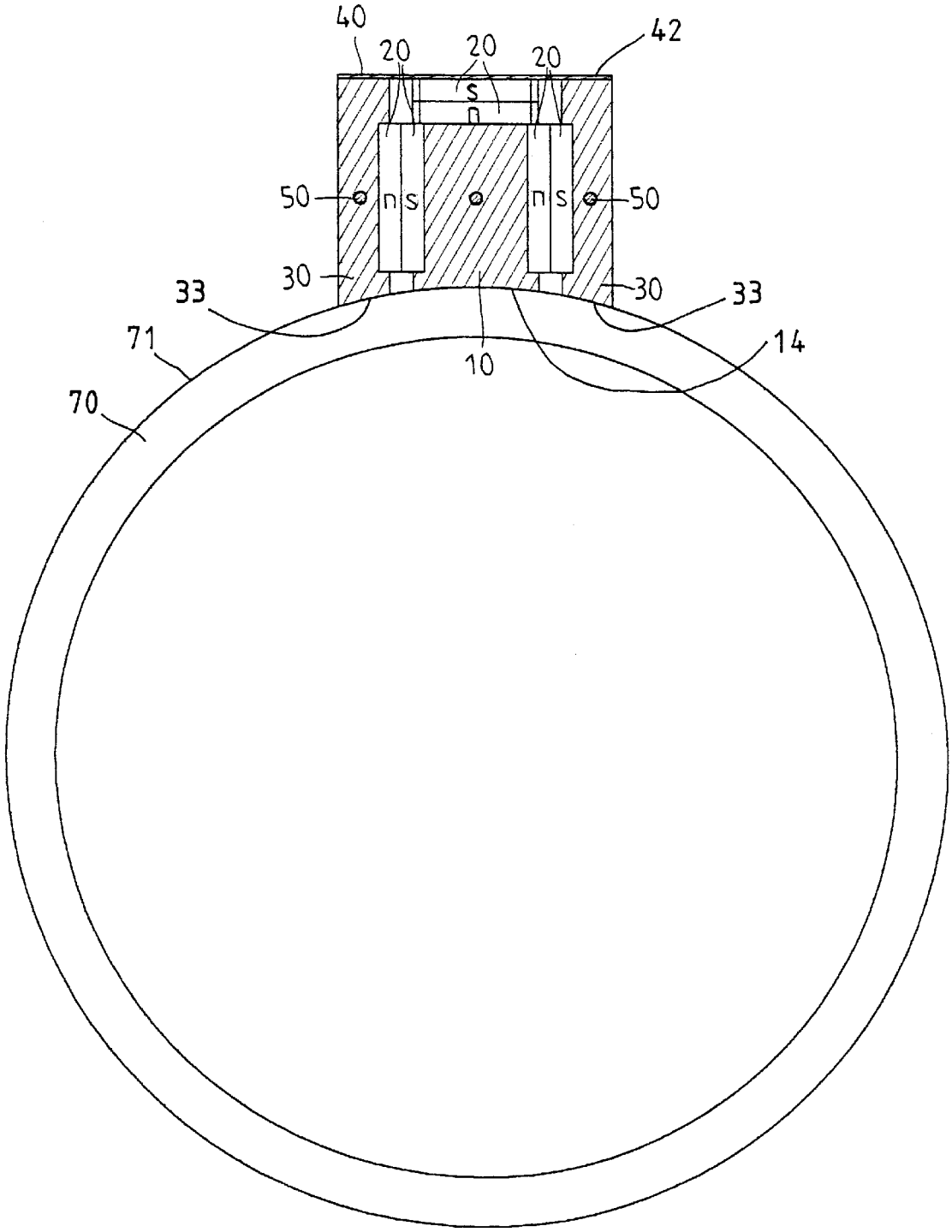
FIG. 11 is a cross sectional view similar to FIG. 8, illustrating the operation of the magnetic device as shown in FIGS. 6–9.

As shown in FIGS. 10, 11, the magnetic device having a unidirectional magnetic line of force and having an increased magnetic field intensity may thus be strongly attached or attracted or secured onto the object 70. The curved outer surface 14 of the plate 12 of the core 10, and the curved outer surfaces 33 of the blocks 30 may be used for snugly attached onto the outer peripheral surface 71 of the object 70 that has the corresponding curvature provided thereon.

Accordingly, the magnetic device in accordance with the present invention includes a number of magnetic members to be secured together to increase the magnetic field intensity thereof, and to form a unidirectional magnetic line of force, for allowing the magnetic device to be solidly or strongly attached or attracted or secured onto various objects.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A magnetic device comprising:

a housing including a chamber formed therein, a core received in said chamber of said housing, and including at least three outer peripheral surfaces, and including a first end received in said chamber of said housing, and including a second end facing out of said housing, said core including a plate provided on said second end thereof, said plate including an outer peripheral portion extended laterally and outwardly beyond said core, at least three magnetic members attached onto said at least three outer peripheral surfaces of said core respectively, said at least three magnetic members including a first pole arranged closer to said core and including a second pole arranged distal to said core, and means for securing said core and said at least three magnetic members in said chamber of said housing.

2. The magnetic device as claimed in claim 1, wherein said plate of said core includes a curved outer surface formed thereon to engage onto objects.

3. The magnetic device as claimed in claim 1, wherein said housing includes a bottom panel, and a plurality of walls extended upwardly from said bottom panel of said housing to form said chamber of said housing.

4. The magnetic device as claimed in claim 1, wherein said housing includes a bottom panel, and at least three outer panels extended upwardly from said bottom panel of said housing to form said chamber of said housing.

5. A magnetic device comprising:

a housing including a chamber formed therein, a core received in said chamber of said housing, and including at least three outer peripheral surfaces, and including a first end received in said chamber of said housing, and including a second end facing out of said housing, at least three magnetic members attached onto said at least three outer peripheral surfaces of said core respectively, said at least three magnetic members including a first pole arranged closer to said core and including a second pole arranged distal to said core, means for securing said core and said at least three magnetic members in said chamber of said housing, and at least three blocks attached onto said at least three magnetic members respectively, and received in said chamber of said housing.

6. The magnetic device as claimed in claim 5, wherein said at least three blocks each include an inner portion having a recess formed therein to partially receive said at least three magnetic members respectively.

7. The magnetic device as claimed in claim 5, wherein said at least three blocks each include a curved outer surface formed thereon to engage onto objects.

8. The magnetic device as claimed in claim 5, wherein said housing includes a bottom panel, and at least three outer panels extended upwardly from said bottom panel of said housing to form said chamber of said housing, and to engage onto said at least three blocks respectively.

9. The magnetic device as claimed in claim 8, wherein said core and two of said at least three blocks each include an aperture formed therein, and two of said at least three outer panels of said housing each include an orifice formed therein, said securing means includes a fastener engaged through said apertures of said core and said two of said at least three blocks and said orifices of said two of said at least three outer panels of said housing, in order to secure said core and said two of said at least three blocks and said two of said at least three outer panels of said housing together.

10. The magnetic device as claimed in claim 4, wherein said housing includes a bottom panel, and a plurality of walls extended upwardly from said bottom panel of said housing to form said chamber of said housing.

11. The magnetic device as claimed in claim 10, wherein said at least three blocks each include an aperture formed therein, and said walls of said housing each include an orifice formed therein, said securing means includes at least three fasteners engaged through said apertures of said at least three blocks and said orifices of said walls of said housing, in order to secure said at least three blocks and said walls of said housing together.

12. The magnetic device as claimed in claim 11 further comprising at least three lock nuts threaded to said at least three fasteners respectively, to solidly secure said at least three blocks and said walls of said housing together.

13. A magnetic device comprising:

a housing including a chamber formed therein, and said housing including a bottom panel, and at least three outer panels extended upwardly from said bottom panel of said housing to form said chamber of said housing, a core received in said chamber of said housing, and including at least three outer peripheral surfaces, and including a first end received in said chamber of said housing, and including a second end facing out of said housing, at least three magnetic members attached onto said at least three outer peripheral surfaces of said core respectively, said at least three magnetic members including a first pole arranged closer to said core and including a second pole arranged distal to said core, said core and two of said at least three magnetic members each including an aperture formed therein, and two of said at least three outer panels of said housing each including an orifice formed therein, and means for securing said core and said at least three magnetic members in said chamber of said housing, said securing means including a fastener engaged through said apertures of said core and said two of said at least three magnetic members and said orifices of said two of said at least three outer panels of said housing, in order to secure said core and said two of said at least three magnetic members and said two of said at least three outer panels of said housing together.

* * * * *